US005954243A

United States Patent [19]

Reilly

[11] Patent Number: 5,954,243

[45] Date of Patent: Sep. 21, 1999

[54] CLOTHING PATTERN HOLDER

[76] Inventor: Sean Reilly, 2020 Ripley La., Merrick, N.Y. 11566

[21] Appl. No.: 09/174,632

[22] Filed: Oct. 19, 1998

[51] Int. Cl.[6] ..... A41H 43/00; A47G 25/14

[52] U.S. Cl. ..... 223/1; 223/DIG. 4; 40/322

[58] Field of Search ..... 223/1, 87, 85, 223/DIG. 4; 40/322; 33/12, 2 R

[56] References Cited

U.S. PATENT DOCUMENTS

| | | | |
|---|---|---|---|
| 1,682,106 | 8/1928 | Banks | 40/322 |
| 2,288,071 | 6/1942 | Cohen | 40/322 |
| 2,801,036 | 7/1957 | Klein | 40/322 |
| 3,932,942 | 1/1976 | Ahajot | 33/17 R |
| 4,995,514 | 2/1991 | Forschner | 33/17 R |
| 5,413,301 | 5/1995 | Cadmar | 223/87 |
| 5,582,387 | 12/1996 | Kolton et al. | 223/87 |

*Primary Examiner*—Bibhu Mohanty
*Attorney, Agent, or Firm*—Myron Amer PC

[57] ABSTRACT

An assemblage of hanger-supported clothing patterns to which there is added laterally extending tags identifying the pattern and providing other pertinent information, in the use of which the tags are readily fanned into positions in facing relation to a user to enable facilitated identification of a clothing pattern of interest.

1 Claim, 2 Drawing Sheets

CLOTHING PATTERN HOLDER

The present invention relates generally to improvements in the storage of garment patterns, the improvements more particularly significantly facilitating the selection from the stored assemblage thereof those specific patterns for a garment of a particular size and fashion.

EXAMPLES OF THE PRIOR ART

Hanger-supported articles of manufacture, such as garments and the like, are known to embody tags on the hanger to convey attributes of the supported article. Exemplary of this practice is U.S. Pat. No. 2,861,726 issued to Whyte for "Collar Support" on Nov. 28, 1958 and U.S. Pat. No. 1,682,106 issued to Banks for "Garment Hanger Support" on Aug. 28, 1928, to mention but a few. On a longitudinally oriented support rod, a tag of one article supported transversely on the support rod is unavoidably obscured by the next adjacent transversely supported article, and so on along the length of the support rod. To read the tag of any supported article requires separation of the assemblage to expose that tag in facing relation to the reading clearance provided by the separation and, as such is a tedious trial and error procedure until the exposed tag happens to be the one that was being sought. Thus, it is the typical practice to go down the line of the assemblage of tagged articles, separating adjacent supported articles one-by-one until coming upon the tagged article being sought.

Broadly, it is an object of the present invention to facilitate the selection of one from many tagged hanger-supported articles, in this case garment patterns in a manner overcoming the foregoing and other shortcomings of the prior art.

More particularly, it is an object to achieve the equivalency of a separating clearance for reading of the tags not by movement of the supported articles, but rather by movement of the tags, such movement being much like the fanning of a deck of playing cards exposes in succession the individual cards thereof, all as will be better understood as the description proceeds.

The description of the invention which follows, together with the accompanying drawings should not be construed as limiting the invention to the example shown and described, because those skilled in the art to which this invention appertains will be able to devise other forms thereof within the ambit of the appended claims.

Figure 2:
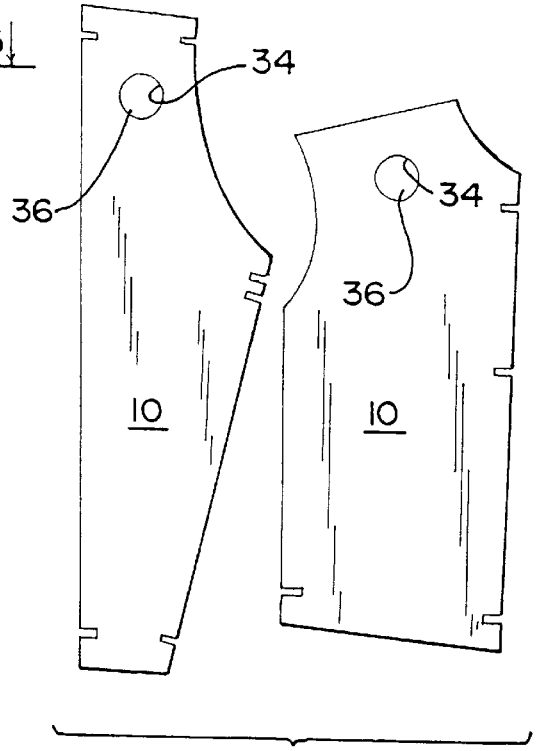
FIG. 2 is a front elevational view of exemplary garment patterns.
Figure 3:
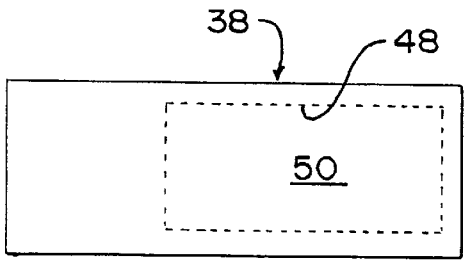
FIG. 3 is a front view of a tag used on the support hanger of FIG. 1.
Figure 4:
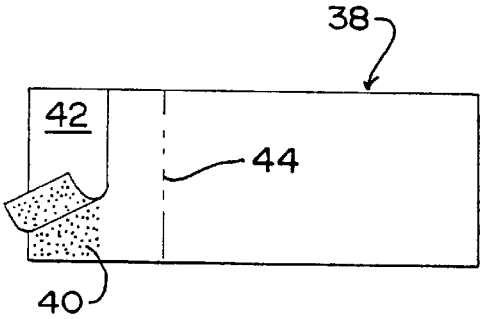
FIG. 4 is a rear view of said tag.
Figure 5:
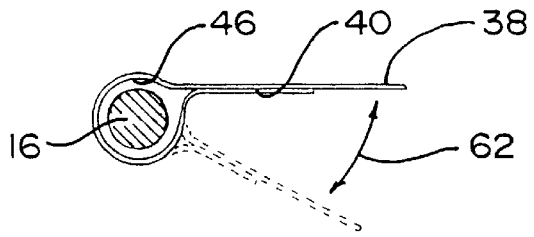
FIG. 5 is a sectional view as seen along line 5—5 of FIG. 1 showing in phantom and full lines positions of movement of said tag.

It is known by common experience that clothing garments are manufactured using patterns of cardboard construction material as exemplified by the two patterns individually and collectively designated 10 in FIG. 2, to produce the shapes and sizes of the patterns 10 in cloth construction material, which are then sewn together to produce a garment (not shown) having desired size and fashion attributes. Typically, a garment manufacturer will have on hand at a manufacturing site several hundred or more patterns, from which a selection is required of the patterns 10 that will produce the specific garment desired, a task that is addressed and greatly facilitated according to the present invention, as will be better understood as the description proceeds.

Figure 1:
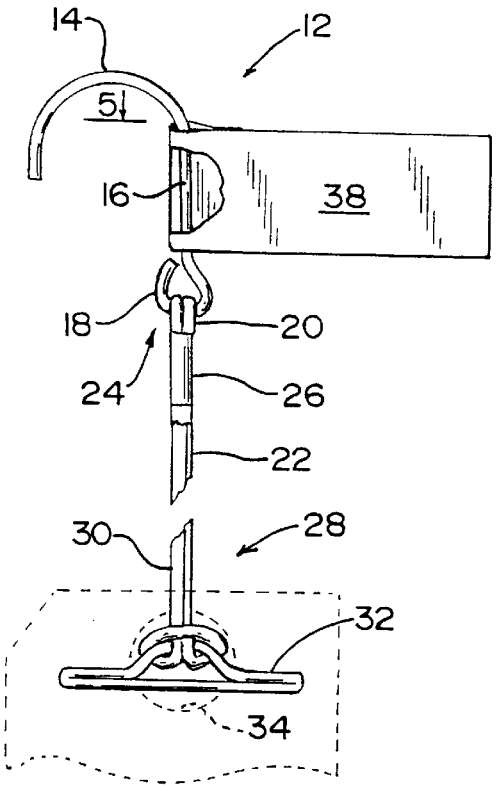
FIG. 1 is an isolated partial front elevational view of a support hanger for garment patterns (shown in phantom perspective)

Illustrated in FIG. 1 is a preferred embodiment of a garment pattern(s)-support hanger 12 having a wire hook configuration 14, a stem or body length portion 16 depending from the hook 14 as illustrated in broken away perspective in FIG. 1, a cooperating pair of interconnected loops 18 and 20, a cord 22 appropriated attached as at 24, to loop 20, and depending from a connection, at 26, an inverted T-shaped support 28 having a first leg 30 and second leg 32 oriented transversely thereof. Each pattern 10 has edges 34 bounding a small diameter opening 36 which is worked onto the horizontal leg 32.

A pattern-identifying tag 38 which in a preferred embodiment is constructed of a cardboard construction material, has an adhesive deposit 40 exposed upon removal of a release strip 42 and then formed by adhesive attachment at reference line 44 into a stem-encircling configuration, as at 46, so that the tag 38 extends laterally of the stem 16 and, most important, is provided with clearance at its attachment site 46 so as to partake of rotative movement about the vertically oriented hanger stem 16.

Tag 38 has a delineated area 48 for imprinting pattern-identifying indicia 50 such as a garment type, model number, size and like particulars.

Figure 6:
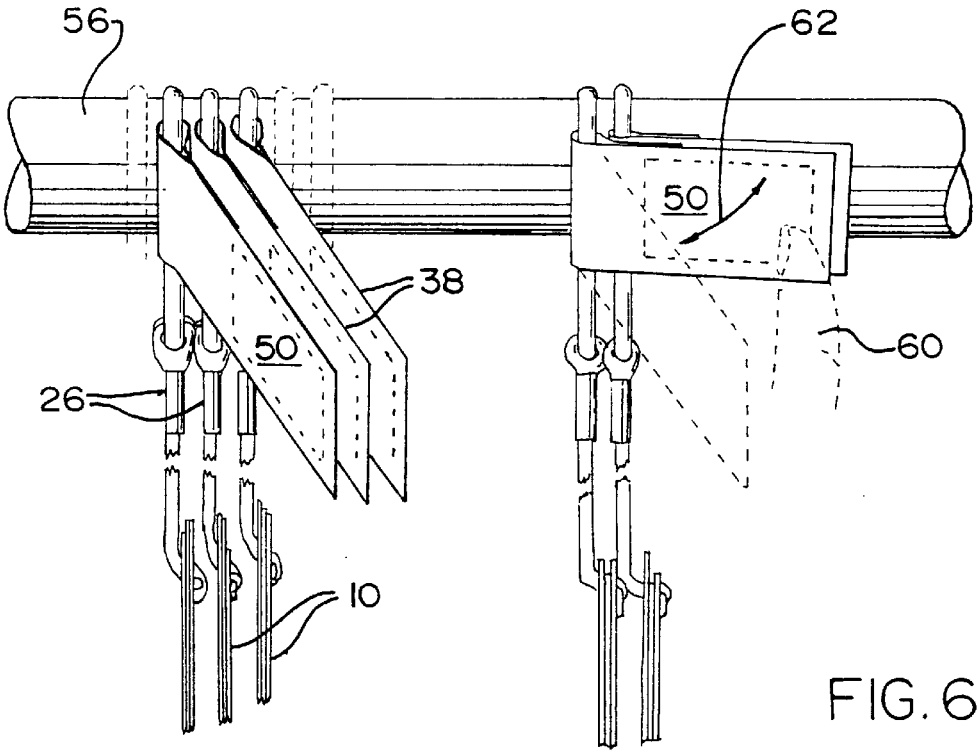
FIG. 6 is a perspective view of plural support hangers with garment patterns thereon in condition preparatory to selection for use.
Figure 7:
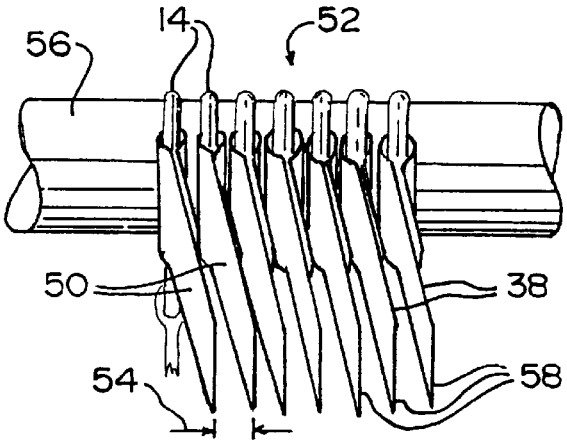
FIG. 7 is a view similar to FIG. 6 but in condition primarily for storage.

As best understood from FIGS. 6 and 7, an assemblage 52 of hangers 12, possibly numbering in the hundreds and each in closely spaced apart relation, as exemplified at 54, are typically crowded together in nominally available space along a support rod 56 and, as a consequence, only the free edge 58 of each tag 38, and not the pattern-identifying indicia 50 thereon, is displayed to an individual attempting to select a specific pattern(s) from the assemblage 52. To facilitate making the required selection, it is recommended that the individual fan the tags 38 in a pivotal traverse using a thumb 60 urged in movement 62, which, it should be readily understood, will place the tags 38 in a one by one succession in facing relation to the individual at each stopping point along the path of movement 62. With an indicia 50 thusly in full view, the hanger 12 is removed from the rod support 56, and the patterns 10 detached from the support leg 32 and used for the purposes intended.

While the apparatus for practicing the within inventive method, as well as said method herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. A method for maintaining for reference preparatory to use plural clothing patterns each of sheet paper construction material, said method comprising the steps of using a hanger with an upper hook configuration of wire construction material for engagement of said hook to an elevated rod support, a lower pattern-engaging support means, and string means connected in spanning relation between said hook and said pattern-engaging support means, attaching a selected number of not less than fifty of said clothing patterns to a cooperating pattern-engaging support means, supporting in a nominal allotted horizontal distance characterized by touching contact of adjacent clothing patterns to each other said assembly of said each hanger and clothing pattern upon an elevated rod support, attaching a pattern-identifying imprinted tag with two delineated panels by folding said tag panels in encircling relation about a base of said wire-constructed hook so as to adapt each tag to partake of a rotative degree of movement, and selecting a clothing pattern being sought by a fan out of said tags, whereby said clothing pattern being sought although not in view between closely adjacent clothing patterns is nevertheless readily identified by its cooperating tag which is in view.

* * * * *